US011414772B2

(12) United States Patent
Todescan

(10) Patent No.: US 11,414,772 B2
(45) Date of Patent: Aug. 16, 2022

(54) ELECTROLYTIC TREATMENT PROCESS FOR COATING STAINLESS STEEL OBJECTS

(71) Applicant: Alberto Todescan, Vicenza (IT)

(72) Inventor: Alberto Todescan, Vicenza (IT)

( * ) Notice: Subject to any disclaimer, the term of this patent is extended or adjusted under 35 U.S.C. 154(b) by 0 days.

(21) Appl. No.: 17/251,870

(22) PCT Filed: Jun. 14, 2019

(86) PCT No.: PCT/IT2019/050137
§ 371 (c)(1),
(2) Date: Dec. 14, 2020

(87) PCT Pub. No.: WO2019/239440
PCT Pub. Date: Dec. 19, 2019

(65) Prior Publication Data

US 2021/0262106 A1 Aug. 26, 2021

(30) Foreign Application Priority Data

Jun. 15, 2018 (IT) ..... 102018000006380

(51) Int. Cl.

| | |
|---|---|
| ***C25D 3/38*** | (2006.01) |
| ***C25D 5/36*** | (2006.01) |
| ***C25D 5/00*** | (2006.01) |
| ***C25D 5/10*** | (2006.01) |
| ***C25D 5/12*** | (2006.01) |
| ***C25D 5/18*** | (2006.01) |
| ***C25D 3/12*** | (2006.01) |
| ***C25D 7/06*** | (2006.01) |
| ***C25D 17/10*** | (2006.01) |
| ***C25D 21/12*** | (2006.01) |

(52) U.S. Cl.
CPC ..... *C25D 3/38* (2013.01); *C25D 3/12* (2013.01); *C25D 5/10* (2013.01); *C25D 5/12* (2013.01); *C25D 5/18* (2013.01); *C25D 5/36* (2013.01); *C25D 5/627* (2020.08); *C25D 7/0614* (2013.01); *C25D 17/10* (2013.01); *C25D 21/12* (2013.01)

(58) Field of Classification Search
None
See application file for complete search history.

(56) References Cited

U.S. PATENT DOCUMENTS

| | | | | |
|---|---|---|---|---|
| 6,099,711 | A | 8/2000 | Dahms et al. | |
| 6,676,823 | B1 * | 1/2004 | Bokisa | C25D 3/38 205/296 |
| 2003/0106802 | A1 * | 6/2003 | Hagiwara | C25D 3/38 205/297 |
| 2009/0223827 | A1 * | 9/2009 | Herdman | C25D 5/627 205/103 |

FOREIGN PATENT DOCUMENTS

| | | |
|---|---|---|
| JP | 2016-074198 | 5/2016 |
| JP | 2017-150050 | 8/2017 |
| WO | WO 2019/239440 | 12/2019 |

OTHER PUBLICATIONS

Machine translation of Fuji et al. JP 2017150050 A (Year: 2017).*
International Preliminary Report on Patentability dated May 13, 2020 From the International Preliminary Examining Authority Re. Application No. PCT/IT2019/050137. (9 Pages).
International Search Report and the Written Opinion dated Oct. 16, 2019 From the International Searching Authority Re. Application No. PCT/IT2019/050137. (9 Pages).

* cited by examiner

*Primary Examiner* — Wojciech Haske

(57) ABSTRACT

Described is a cathodic treatment for the electrodeposition of a metal layer securely adherent to the surface of stainless steel objects in an electrolytic bath comprising one or more metals belonging exclusively to the groups from 3 to 12 of the periodic table, excluding the elements nickel, cobalt, cadmium, ruthenium, rhodium, palladium, silver, osmium, iridium, platinum, gold and rhenium, and methanesulfonic acid with a concentration of between 100 and 400 g/l.
An object of the invention is also a process for applying a metal layer securely adherent to the surface of stainless steel objects, comprising a cathodic treatment as described above. Moreover, the invention further relates to an object comprising stainless steel equipped with a covering obtained by means of a process of the type described.

9 Claims, 2 Drawing Sheets

The cycle can consist of the independent combination of 3 steps.
More cycles can be combined with each other.

ELECTROLYTIC TREATMENT PROCESS FOR COATING STAINLESS STEEL OBJECTS

RELATED APPLICATIONS

This application is a National Phase of PCT Patent Application No. PCT/IT2019/050137 having International filing date of Jun. 14, 2019, which claims the benefit of priority of Italian Patent Application No. 102018000006380 filed on Jun. 15, 2018. The contents of the above applications are all incorporated by reference as if fully set forth herein in their entirety.

FIELD AND BACKGROUND OF THE INVENTION

This invention relates to a system for electrolytic treatment on stainless steel to allow subsequent electrodeposition operations of other metal coatings. In particular, but not in a limiting manner, the invention is suitable for use for making objects for personal use, so in a close relationship with the person, often with prolonged contact with the skin.

The following categories of objects may be mentioned by way of example: frames for spectacles, watches, jewellery and ornaments, pens, clothing accessories, and in any case those articles which require environmental health and an allergy-free condition, as will be described in detail below.

More in particular, the invention relates to a process for applying a layer of metal securely adherent to the stainless steel substrate, made by electrodeposition from an aqueous solution of metals which can be electrodeposited belonging exclusively to the groups from 3 to 12 of the periodic table (group of transition metals), excluding the elements nickel, cobalt, and cadmium, due to their danger to health and the elements ruthenium, rhodium, palladium, silver, osmium, iridium, platinum, gold and rhenium, due to their high cost.

Stainless steel, which is widely used in many production sectors due to its corrosion-resistant characteristics, is suitable for manufacturing articles which are to have prolonged contact with the skin. In particular, on the basis of recent studies some types are considered to be free from the risk of transfer of nickel.

In current practice, stainless steel is often used in combination with other metals, many of which require electrolytic coating treatments for functional or aesthetic reasons. The use of electroplating treatments suitable for also being efficiently applied to stainless steel is therefore indispensable.

It is known that stainless steel, due to its layer of chromium oxide which protects it, requires surface treatments for the application of coatings with adequate adherence characteristics.

The degree of adhesion is a determining factor to guarantee the compliance of the final product to the many situations of use. A correct preparation of the surface must be followed by an efficient and safe treatment system, without critical issues in the mode of application. In fact, shortcomings in the adhesion are difficult to detect, without specific tests, which are sometimes destructive, and constitute a serious risk for the subsequent functionality of the article.

The systems currently in use are:

1. Roughening of the surface, by means of mechanical or electrolytic (anodic dissolution) treatments; these methods are generally limited to technical articles which are to be subsequently covered by means of autocatalytic systems (for example, "electroless nickel plating"), which, even though they do not have adherence characteristics on stainless steel, are characterised by the capacity to produce continuous coatings, with a "sheath" effect.

2. Electrolytic nickel-plating performed using the so-called Wood's nickel bath, consisting of $NiCl_2$ 24% in solution of 4% of HCl (U.S. Pat. No. 2,437,409).

3. Gilding obtained from electrolytes with pH less than 2.0 based on $AuCl_3$ or $AuK(CN)_4$ with quantities varying between 2.0 and 4.0 g/l of Au metal, in the presence of various types of additives.

In the first case, it is not at all effective when it receives electrolytic coatings. Moreover, this solution is obviously not applicable to shiny surfaces without modifying their brightness, and for this reason the majority of the objects for personal use are excluded.

In the second case, this solution cancels out the features of stainless steel, due to the application of a layer of nickel, which is an easily corrodible metal. In the case of articles designed to come into contact with the skin, the presence of non-alloy nickel results in the need to apply a protective coating, to avoid its transfer even after a prolonged use of the article, and to demonstrate that the article does not cause allergic reactions, by means of analytical procedures which are time-consuming and of limited reliability. Moreover, this solution advantageously requires the use of processes which are considered carcinogenic for the operators.

In the third case, the solution is economically valid only in the case of processes for the final gilding of stainless steel; used as a pre-treatment, it results in a waste of gold, an extremely costly material, destined to be covered by less noble materials (e.g. copper and its alloys). The degree of adhesion is also insufficient to pass the tests normally requested (see below).

There is therefore the need for a solution which allows stainless steel to be used, in particular on objects for personal use, which is not harmful for the users and non-toxic for the operators involved, and which is also technically efficient and convenient from the economic point of view.

SUMMARY OF THE INVENTION

The aim of this invention is to overcome the above-mentioned drawbacks and to provide a reliable process for the application of a metal layer which is securely adherent to a stainless steel surface.

This aim, as well as these and other aims which will emerge more fully below, are attained by a process for the application of a metal layer according to appended claim 1.

Detailed steps of the process according to the invention are indicated in the corresponding dependent claims.

A specific object of the invention is therefore a process for applying a metal layer securely adherent to the surface of stainless steel objects, comprising the following operations, according to the procedures adopted in the operational practice:

1. Elimination of processing residue, such as scales or plates, by means of mechanical and/or chemical processes as required;
2. Elimination of oil, grease or other foreign substances by means of appropriate degreasing treatments;
3. Cathodic or anodic electrolytic activation;
4. Electrodeposition of the covering adherent to the stainless steel surface;
5. Deposition of further functional and/or decorative coverings.

In the case of objects designed for personal use, due to the surface finishing processes to which these are generally subjected before the electroplating treatments, an example of consecutive steps of a treatment according to the invention can be as follows:

a) degreasing
b) rinsing;
c) cathodic electrolytic activation in a solution consisting of a mixture of mineral or carboxylic acids and/or their salts;
d) rinsing in demineralized water;
e) treatment in an electrodeposition bath comprising one or more transition metals, one or more substances consisting of sulphonic acid derivatives, according to a general formula R—$SO_3H$, one or more additives for improving the characteristics and the adherence of the covering;
f) rinsing;
g) further functional or decorative covering treatments, if necessary, but not necessarily, after a pre-treatment cycle such as the following:
   i. cathodic electrolytic degreasing;
   ii. rinsing;
   iii. activation in acid solution;
   iv. rinsing.

In particular, the sulphonic acid derivatives of point e) allow the bath to be the most efficient for the electrodeposition, and can consist of:

1. compounds of the type

R—$SO_3H$ where R=linear or branched and/or cyclic derivatives also containing heteroatoms (such as N, O, S) of alkanes, alkenes, alkynes and their combinations. These groups can, in turn, if necessary be replaced with groups such as those listed below: with reference to the above formula, R can be: halide (F, Cl, Br, I), derivatives of alkanes, alkenes, alkynes, arylic groups, arylic alykl, carboxyls, carbonyls, thiols, nitrogen groups (e.g. nitro and/or nitrous, amminic, ammidic etc), cyclic substituents and/or cyclic substituents containing heteroatoms (such as N, O, S) and/or more sulphonic groups. The combination of one or more of the categories listed with the addition of the hydroxyl group is also contemplated.

2. Derived compounds of benzenesulfonic and naphthalenesulfonic acids of the type:

FIG. 1

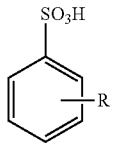

FIG. 2

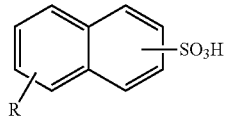

but also aromatic compounds consisting of polycondensation rings; for example, but not limited to: derivatives of anthracene, tetracene, pyrene, azulene, phenanthrene, annulene, benzopyrenes) and/or aromatic compounds containing heteroatoms (such as N, O, S).

The substituent group R can be: hydrogen, hydroxyl, halide (F, Cl, Br, I), saturated and/or unsaturated alkyl groups, arylic, arylic alykl, carboxyls, carbonyls, several sulphonic groups, thiols, nitrogen groups (e.g. nitro and/or nitrous, amminic, ammidic etc), cyclic substituents and/or cyclic containing heteroatoms (N, O, S). The combination of one or more of the categories listed is also contemplated.

In general, however, all the sulphonic acid derivatives which are generally commercially available or which can be prepared by means of synthesis methods known in the literature are included.

The invention can comprise transition metals comprising copper, with a concentration of between 0.1 and 10 g/l, preferably between 0.25 and 2.5 g/l.

In fact, the presence of copper guarantees an optimum operation of the process, even though it is not the only metal which can be used.

Again according to the invention, the substances of the group indicated with R, as indicated above, can comprise methanesulfonic acid, with concentrations of between 10 and 600 g/l, preferably between 100 and 400 g/l.

In particular, amongst all the acids which are most easily found on the market, methanesulfonic acid is the one which is able to provide the best results for the process.

Preferably, according to the invention, the step of treatment in an electrodeposition bath provides for one or more additives with the function of grain refiners, which comprise, for example, saccharin sodium salt or polyethylene glycol, in concentration between 0.1 and 2.0 gr/l, preferably between 0.4 and 1.0 gr/l.

In fact, these allow a more homogeneous and consistent covering to be obtained.

Further, the invention can comprise one or more pickling agents to eliminate surface oxides and/or one or more chelating agents for the formation of complexes of the metals present in the solution during step e); in this way it is possible to improve both the adherence of the covering on the metal substrate and its final thickness.

Moreover, according to the invention, the step of treatment in an electrodeposition bath can comprise a cathode electrolyte treatment with pulsed current.

This advantageously allows particular structures to be obtained and improves the distribution of the coating, with consequent characteristics greater than those which can be achieved with the use of the constant current.

For example, at least one impulse could be positive, advantageously producing the growth of the electrolytic covering following the sending of negative electrical charges.

In this case, the first impulse and the second impulse can both be positive.

This would advantageously allow an improved compactness of the coating to be obtained.

Also, the first impulse and the second impulse could have different intensities, for example each with a duration in the order of milliseconds and with values which can be equal or different.

Equally preferably, the pulsed current cycle can comprise a third impulse, with a current intensity equal to 0.

The characteristics described above advantageously translate into an improvement of the performance of the covering with regard to the adherence to the substrate and the homogeneity of the thicknesses applied.

The invention also relates to an object made of stainless steel, in particular but not limited to those for personal use, either by itself or coupled with other metals and covered by means of the process.

BRIEF DESCRIPTION OF THE SEVERAL VIEWS OF THE DRAWINGS

Further characteristics and advantages of the invention will emerge more fully from the description of a preferred but not exclusive embodiment of a process for applying a metal layer according to the invention, illustrated by way of non-limiting example in the appended drawings, in which.

DESCRIPTION OF SPECIFIC EMBODIMENTS OF THE INVENTION

The invention relates to a process for applying a metal layer securely adherent to the surface of stainless steel objects, in particular, but not necessarily, limited to the following types of steel:

AISI 301
AISI 304
AISI 310
AISI 316
AISI 430 some of these satisfy the limits of transfer of nickel specified by the European standards, EN 1811 of March 2011, EN 16128 of March 2011, EN 12472 of October 1998 (Ref. European Union Risk Assessment Report).

In particular, the invention relates to an electrodeposition treatment cycle comprising the following steps:

1. Degreasing of parts contaminated with oil, grease and organic substances in general. The techniques and the products used in this step are well known and do not therefore constitute an object of the invention.

2. Rinsing (of known type, and which does not constitute an object of the invention).

3. Cathodic electrolytic activation (objects connected to negative pole of current supply unit). The solution consists of a mixture of mineral or carboxylic acids and their salts. The aim of the treatment is to ensure a perfect adherence of the coating also on surfaces affected by abnormal oxidation, deriving from processes such as localised heating, prolonged polishing or particular mechanical processes. The techniques and the products used in this step are well known and do not therefore constitute an object of the invention.

4. Rinsing in flowing demineralized water (of known type, and which does not constitute an object of the invention).

Figure 1:
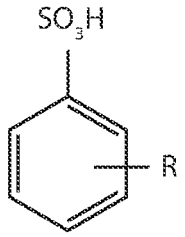
FIG. 1 shows a first variant of a compound used in the process according to the invention.
Figure 2:
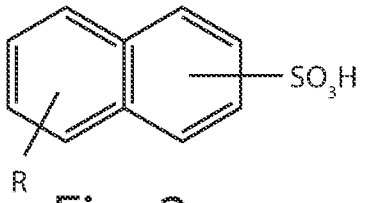
FIG. 2 shows a second variant of a compound used in the process according to the invention.

5. Treatment in an electrodeposition bath comprising one or more metals belonging exclusively to the groups from 3 to 12 of the periodic table (transition metals), excluding the elements nickel, cobalt, cadmium, ruthenium, rhodium, palladium, silver, osmium, iridium, platinum, gold and rhenium, one or more substances selected amongst those described above (for example as specified in FIGS. 1 and 2) and in particular methanesulfonic acid, preferably in concentrations between 100 and 400 g/l; in addition, one or more additives can be used in the electrodeposition bath with the function of grain refiners, and/or one or more chelating agents for the complexing of the metals present in solution, and/or one or more pickling agents for eliminating surface oxides.

Advantageously, the use of the chemicals described allows a coating to be obtained, already at the outlet from the electroplating bath, which is perfectly adherent to the steel substrate and extremely resistant to mechanical stresses, without the need for subsequent treatments or processes.

This characteristic implies, obviously, an increase in the quantity and quality of the parts which can be produced by a galvanic system, and it has the advantage of simplifying the implementation and the actuation of the process also in existing systems, as it does not require the introduction of additional steps and/or instrumentation inside the production lines.

This renders the process according to the invention more convenient than the prior art, in terms of time, cost and safety.

Figure 3:
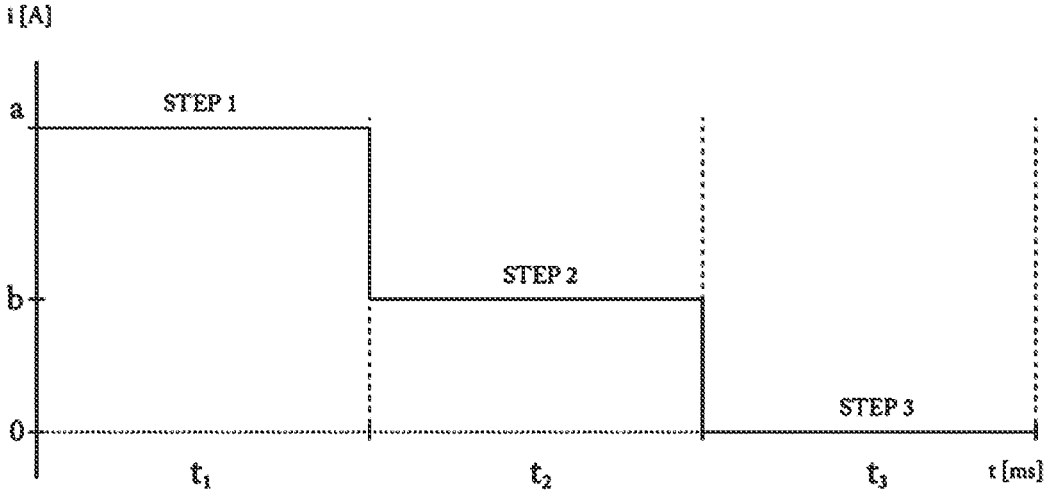
FIG. 3 is a graph which describes a step of a first preferred embodiment of the process according to the invention.
Figure 4:
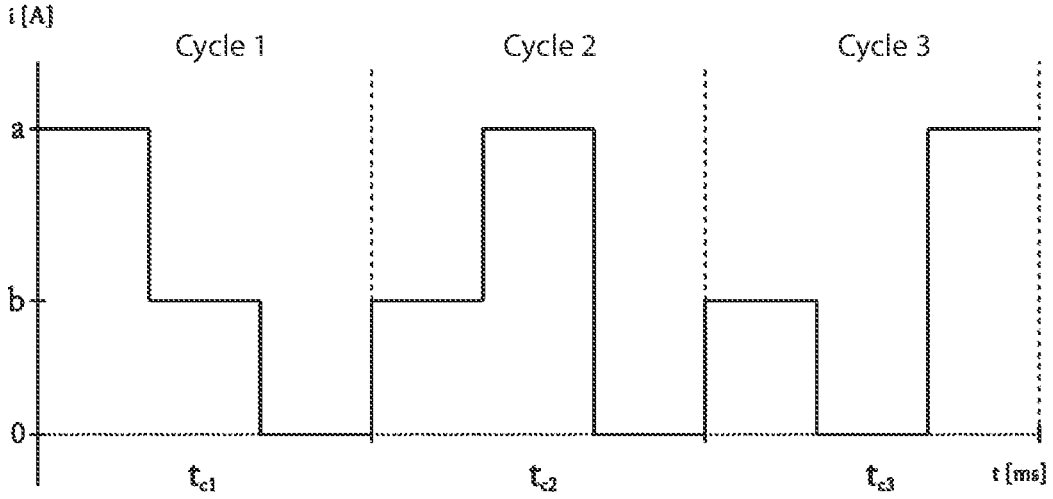
FIG. 4 is a graph which describes a step of a second preferred embodiment of the process according to the invention.

The application of the metal covering occurs by means of cathode electrolyte treatment as shown, for example, in FIGS. 3 and 4 (objects connected to the negative pole of the current supply unit, which may be constant or pulsed).

6. Rinsing (of known type, and which does not constitute an object of the invention).

7. Cathodic electrolytic degreasing (of known type, and which does not constitute an object of the invention).

8. Rinsing (of known type, and which does not constitute an object of the invention).

9. Activation in acid solution (of known type, and which does not constitute an object of the invention).

10. Rinsing (of known type, and which does not constitute an object of the invention).

11. Electrodeposition of further layers of metal from suitable electrolytic baths (does not constitute an object of the invention).

The aim of the following examples is to illustrate preferred but non-limiting embodiments of the invention, provided by way of example only.

EXAMPLE 1

Electroplating bath for forming a coating adherent on stainless steel surfaces:

| Substance | Concentration (g/l) |
|---|---|
| Copper (II) as methanesulfonate | 2.0 |
| Methanesulfonic acid (70%) | 350 |
| Nitrilotriacetic acid (NTA) sodium salt | 10.0 |

The pH of the solution is less than 1. A plate of AISI 316L steel, subjected to the process described above, has been treated in the electroplating bath (step 5) at a temperature of 25° C. for 45 seconds, at the current density of 2.0 A/dm$^2$, using titanium anodes coated with mixed oxides.

This has achieved a coating of copper with a semi-shiny appearance, perfectly adherent to the steel surface, with an average thickness of 0.2 μm, measured by means of an XRF spectrophotometer.

A layer of copper from acid electrolyte copper with shiny copper plating was subsequently applied, with an average thickness of 8.7 μm.

The plate was lastly subjected to ASTM B 571 adhesion testing (9. Heat-Quench Test) without signs of delamination, even after bending on a spindle with a diameter of 10 mm.

EXAMPLE 2

Electroplating bath for forming a coating adherent on stainless steel surfaces:

| Substance | Concentration (g/l) |
|---|---|
| Copper (II) as methanesulfonate | 1.5 |
| Methanesulfonic acid (70%) | 250 |
| NTA sodium salt | 15.0 |
| Polyethylene glycol | 0.2 |

The pH of the solution is less than 1. A plate of AISI 316L steel, subjected to the process described above, has been treated in the electrodeposition bath (step 5) at a temperature of 25° C. for 90 seconds, using titanium anodes coated with mixed oxides.

This has achieved a coating of copper with a shiny appearance, perfectly adherent to the steel surface, with an average thickness of 0.25 μm, measured by means of an XRF spectrophotometer.

A layer of copper from acid electrolyte copper with shiny copper plating was subsequently applied, with an average thickness of 10.2 μm.

The plate was lastly subjected to ASTM B 571 adhesion testing (9. Heat-Quench Test) without signs of delamination, even after bending on a spindle with a diameter of 10 mm.

EXAMPLE 3

Electrodeposition bath for forming a coating adherent on stainless steel surfaces. Use of pulsed current to improve the distribution of the coating for objects with a complex shape. Measurement of the thicknesses obtained on three 3.5×2.5 cm AISI 316L steel plates bent at 90° in a longitudinal direction, performed by means of the XRF spectrophotometer, after the treatments indicated in Table 1 below.

Figure 5:
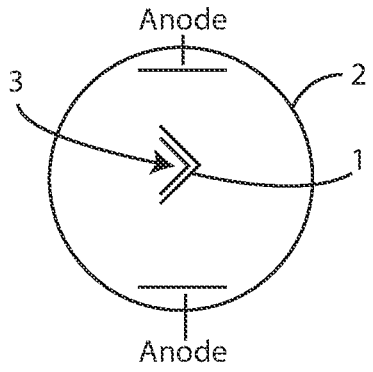
FIG. 5 shows a preferred work configuration during a step of the process according to the invention.

The measurements of the thicknesses were carried out in seven points distributed in a regular manner along the mid-point line inside the corner 3 of the plates 1, as indicated in FIG. 5.

0.5 litres of the bath described in Example 2 were placed in a Pyrex® glass container containing two titanium anodes coated with mixed oxides, connected to the positive pole of the current supply unit.

With reference to FIG. 5, the plates 1, for example bent to 90°, were suspended at the centre of the container 2 and connected to the negative pole of the current supply unit.

The solution was kept in movement by means of a magnetic stirrer which rotated a plasticized magnetic cylinder.

Operating conditions of the plates for all three tests:

1) Temperature: 25° C.
2) Depositing time: 2 minutes
3) Stirrer speed: 250 revs per minute
4) Dimensions of magnet: 25 mm ø5 mm.

In particular, with reference to FIGS. 3 and 4, current pulses can be supplied to favour electrodeposition.

The current used in this series of tests, during step 5 of the process according to the invention, has the following parameters:

TABLE 1

| TEST | CURRENT | STEP 1 | STEP 2 | STEP 3 |
|---|---|---|---|---|
| a | constant | 0.35 A for 2 minutes | = | = |
| b - total time 2 minutes | pulsed | 0.47 A for 2 ms | 0.23 A for 1 ms | = |
| c - total time 2 minutes | pulsed | 0.47 A for 2 ms | 0.23 A for 1 ms | 0 A for 0.5 ms |

Results obtained:

TABLE 2

| SAMPLE | THICKNESSES MEASURED AVERAGE VALUE | MAXIMUM VALUE | MINIMUM VALUE | sigma (standard deviation) |
|---|---|---|---|---|
| a | 0.24 μm | 0.34 μm | 0.17 μm | 0.07 |
| b | 0.23 μm | 0.29 μm | 0.17 μm | 0.05 |
| c | 0.24 μm | 0.33 μm | 0.16 μm | 0.06 |

With reference to Tables 1 and 2, it is evident that cycles formed by combinations consisting of sequences of steps as indicated above can be adopted, alternated with variable modes and repeated a sufficient number of times to form the desired covering thickness.

In this case, in fact, considerable advantages are obtained in terms of compactness of the covering, ductility and greater uniformity of its surface distribution.

According to a preferred variant of the invention, the composition of the electrolytic solution is modified by adding to the above-mentioned components one or more compounds consisting of hydrofluoric acid (HF) or one of its derivatives, such as: metallic salts, ammonia salts or organic compounds of fluorine, with a quantity such as to obtain in the solution a quantity of fluorine variable from 0.5 to 50 g/l, preferably between 2.0 and 20.0 g/l.

These compounds act as pickling agents, which remove the surface layer of chromium oxide from the steel and facilitate its covering with another metal.

EXAMPLE 4

Electrodeposition bath for forming a coating adherent on stainless steel surfaces:

| Substance | Concentration (g/l) |
|---|---|
| Copper (II) as methanesulfonate | 1.0 |
| Methanesulfonic acid (70%) | 300 |
| NTA sodium salt | 10.0 |
| Ammonium fluoride acid (NH4FHF) | 15.0 |

The pH of the solution is less than 1. Some steel plates, subjected to the process described above, have been treated in the electrodeposition bath at a temperature of 25° C. for 45 seconds, at the current density of 2.0 A/dm$^2$, using graphite anodes. The plates used were made of AISI 304 steel, with dimensions of 35×25×0.15 mm, and a total surface area of 0.18 dm$^2$.

This has achieved a coating of copper with a semi-shiny appearance, perfectly adherent to the steel surface, with an average thickness of 0.1 μm, measured by means of an XRF spectrophotometer.

By operating according to the procedures described below, it has been seen that the use of the system described in this example guarantees better results than those obtained with the Wood's nickel bath.

The Wood's nickel bath used has the following composition:

250 g/l of $NiCl_2 \cdot 6H_2O$ 120 ml/l of HCl sol. 37%

It has been considered worthwhile to experimentally compare the performance levels of the coverings obtained by means of the formulation of Example 4 with those obtained by means of the acid gilding, Wood's nickel bath and the Examples 1 and 2, testing the adhesion force of each of these up to limit conditions.

Layers of electrolytic nickel coating (which are notoriously characterised by high hardness and non-deformability values) have been applied to the samples, consisting of stainless steel plates treated with the various fastening formulations, with increasing thicknesses; using indirect measurements, the plates have then been deformed by wrapping around a spindle and the behaviour of the various treatments has been checked.

Treatment cycles applied to the plates and relative operating conditions:

A. Pre-Treatments

Prior to the electrolytic electrodeposition, both by means of Wood's nickel bath and by means of the various formulations according to the invention, there is a degreasing step, in common for all the variants of the invention.

The degreasing process comprises the following steps:

1) ultrasound washing in 3% solution of detergent for ultrasound washing (for example, the detergent commercially known with the code DS 904 by Dantecaneva Srl code PRE04001, a mixture of detersives and additives for ultrasound washing), for a duration of 30 seconds at a temperature of 70° C.;

2) Cathodic electrolytic degreasing in 10% solution of detergent for the electrolytic degreasing of metals (for example, the detergent known commercially as Fer 540 by Dantecaneva Srl code PLT90001, a mixture of detersives and alkaline salts for the electrolytic degreasing of metals), for a duration of 30 seconds, at a temperature of 25° C. and current density equal to 5 A/dm$^2$.

After the degreasing, and before the electrodeposition, there is a step for electrolytic activation of the samples in an acid solution of 10% of acid salts (for example, the mixture known commercially with the name Solvadec, by Dantecaneva Srl code CHI76001, a mixture of acid salts for the activation of metallic surfaces); if the subsequent electrodeposition occurs by means of the Wood's nickel bath, the activation is performed by immersion of the samples in the acid solution for 30 seconds at 25° C., without the passage of current, since the subsequent cathodic treatment in the Wood's nickel bath simultaneously carried out the functions of activation and covering.

If, on the other hand, the electrodeposition occurs by using one of the formulations according to the invention or the acid gilding bath, the activation is obtained by means of a cathode electrolyte treatment in the same acid solution and at the same temperature of 25° C., for a time of 60 seconds and with a current density of 3 A/dm$^2$.

B. Electrodeposition of the Fastening Layer

The application of the metal coating was performed by means of cathode electrolyte treatment (plates connected to the negative pole of the continuous current supply unit, with constant intensity).

B1. The acid gilding treatment was performed using a bath comprising 2 g/l of gold $AuK(CN)_4$, 2 g/l of $CoSO_4$, 100 g/l of citric acid and 25 g/l of orthophosphoric acid. Platinum-plated titanium anodes have been used, with the following process parameters:

1) Temperature: 35° C.

2) Depositing time: 1.5 minutes

3) Current density: 1.5 A/dm$^2$

B2. The treatment in Wood's nickel bath comprises the use of nickel anodes, with the following process parameters:

1) Temperature: 25° C.

2) Depositing time: 1.5 minutes

3) Current density: 2.3 A/dm$^2$

B3. The treatment according to the invention comprises the use of graphite anodes, with the following process parameters:

1) Temperature: 25° C.

2) Depositing time: 1.5 minutes

3) Current density: 1.5 A/dm$^2$

C. B. Electrodeposition of the Shiny Nickel Layer

The application of the nickel covering is performed by means of cathode electrolyte treatment in a Wood's nickel bath; nickel anodes and the following process parameters are used:

1) Temperature: 60° C.

2) Depositing time: variable

3) Current density: 2.0 A/dm$^2$

Results of Adhesion Tests

In order to indirectly assess the adherence of the nickel coating, the coated plates were deformed by placing the flat surface of the plates on an 8 mm diameter spindle, until the two ends were parallel; the results given below showed, for the same thickness, the convenience of the covering applied by means of the formulation of Example 4, both with respect to the Wood's nickel bath and the acid gold, and also with respect to the formulation of Examples 1-2 (the result can be seen from the comparison of the lines highlighted in the following table).

| | | Shiny nickel deposited | | Detached |
|---|---|---|---|---|
| Sample | Fastening layer type | mg | Thickness calculated (μm) | surface[1] (%) |
| 5N | Wood Nickel | 73.1 | 4.56 | 0 |
| 5C | Example 4 | 75.1 | 4.68 | 0 |
| 1D | Acid gold | 90.5 | 5.65 | 10 |
| 4N | Wood Nickel | 105.1 | 6.55 | 0 |
| 6C | Example 4 | 101.2 | 6.31 | 0 |
| 8N | Wood Nickel | 122.4 | 7.63 | 30 |
| 8C | Example 4 | 126.9 | 7.91 | 5 |
| 2D | Acid gold | 136.6 | 8.52 | 100 |
| 7N | Wood Nickel | 162.1 | 10.11 | 60 |
| 7C | Example 4 | 170.1 | 10.61 | 30 |
| 1N | Wood Nickel | 64.9 | 4.05 | 0 |
| 1C | Examples 1-2 | 60.3 | 3.76 | 0 |
| 2N | Wood Nickel | 87.9 | 5.48 | 0 |
| 2C | Examples 1-2 | 88.7 | 5.53 | 10 |

[1]percentage of the surface detached from the stainless steel in the deformed zone.

The present invention has been described by way of example only, without limiting the scope of application, according to its preferred embodiments, but it shall be understood that the invention may be modified and/or adapted by experts in the field without thereby departing from the scope of the inventive concept, as defined in the claims herein.

What is claimed is:

1. A method for the electroplating of a metal layer securely adherent to the surface of stainless steel objects, which includes a step of cathodic treatment in an electrolytic bath comprising methanesulfonic acid with a concentration of between 100 and 400 g/l, and one or more metals in an aqueous solution, wherein said one or more metals that are electroplated belong exclusively to the groups from 3 to 12 of the periodic table, excluding the elements nickel, cobalt, cadmium, ruthenium, rhodium, palladium, silver, osmium, iridium, platinum, gold and rhenium, and wherein the electrolytic bath comprises one or more chelating agents, for the formation of complexes of the metals present in the solution, and one or more pickling agents, for the removal of surface oxides.

2. The method according to claim 1, wherein said one or more metals comprise copper with a concentration of between 0.1 and 10 g/l.

3. The method according to claim 1, wherein said electrolytic bath comprises one or more additives with the function of grain refiners with a concentration of between 0.1 and 2.0 gr/l.

4. The method according to claim 1, wherein the method uses pulsed current, wherein at least one impulse is positive.

5. The method according to the claim 4, wherein said pulsed current is delivered in at least one cycle of one first impulse and one second impulse, said first impulse and second impulse both being positive.

6. The method according to the claim 5, wherein said first impulse and said second impulse have different values of current intensity.

7. The method according to claim 5, wherein the at least one cycle comprises a third impulse, with zero current intensity.

8. The method according to claim 1, wherein said one or more metals comprise copper with a concentration of between 0.25 and 2.5 g/l.

9. The method according to claim 1, wherein said electrolytic bath comprises one or more additives with the function of grain refiners with a concentration of between 0.4 and 1.0 gr/l.

* * * * *